US005611544A

United States Patent [19]

Grebler et al.

[11] Patent Number: 5,611,544

[45] Date of Patent: Mar. 18, 1997

[54] STACKING BRICK TOWER GAME

[75] Inventors: Robert K. Grebler, Santa Monica; Paul Eveloff, San Anselmo; James E. Sheftel, Santa Monica, all of Calif.

[73] Assignee: Pokonobe Associates, Larkspur, Calif.

[21] Appl. No.: 562,671

[22] Filed: Nov. 27, 1995

[51] Int. Cl.[6] ..... A63F 9/00

[52] U.S. Cl. ..... 273/447; 273/450

[58] Field of Search ..... 273/447, 448, 273/450; 446/85, 117, 118

[56] References Cited

U.S. PATENT DOCUMENTS

| | | | |
|---|---|---|---|
| 3,712,616 | 1/1973 | Goldfarb et al. | 273/447 |
| 3,899,169 | 8/1975 | Rhodes et al. | 273/450 |
| 4,522,393 | 6/1985 | Dunn | 273/450 X |
| 4,902,010 | 2/1990 | Davis et al. | 273/450 |

FOREIGN PATENT DOCUMENTS

| | | | |
|---|---|---|---|
| 190876 | 8/1986 | European Pat. Off. | 273/447 |
| 2185691 | 7/1987 | United Kingdom | 273/447 |

OTHER PUBLICATIONS

Creative Playthings catalog, 1969–1970 p. 23 "Toppler".

*Primary Examiner*—Paul E. Shapiro

*Attorney, Agent, or Firm*—Robbins, Berliner, & Carson, LLP

[57] ABSTRACT

A game is played by building a tower of bricks in multiple levels, and players alternately removing a brick from one level and adding it to the top of the tower to build new levels, until collapse of the tower occurs. Bricks of a variety of different types are provided with each type having different physical characteristics, such as shape, size, surface configuration and/or coefficient of friction. At least two adjacent layers of the initial tower are formed from bricks of different types.

19 Claims, 11 Drawing Sheets

STACKING BRICK TOWER GAME

TECHNICAL FIELD

The invention relates generally to games of skill, and more particularly to a game in which one or more players build a collapsible tower from individual bricks.

BACKGROUND ART

Tower building games are known in which a number of rectangular bricks are arranged in layers to form a tower, with the orientation of the rectangular bricks alternating from one layer to the next to provide frictional coupling between layers and adjacent bricks in the same layer. During a typical play scenario, the height of the tower is increased by removing bricks from one or more lower layers to build successive upper layers. A brick is a key brick if it is directly under the center of gravity of the bricks above it and is (or will be) the only brick in a given layer, or if it is one of two remaining bricks on either side of the center of gravity of the bricks above it. The game ends if the tower collapses because a key brick has been removed, or if the tower becomes unstable or is knocked over during the attempted removal of any brick. Since there may be slight variations in the thickness of the individual bricks or the tower may not be exactly vertical, the weight of the upper layers may not be evenly distributed on all bricks of a given layer. Accordingly, even a brick which is not a key brick may be supporting much of the weight of the tower in which case one or more bricks in adjacent layers will be dragged out of position by friction when the weight-supporting brick is removed. Thus, it is conventional to permit players to test for loose bricks before deciding which brick to remove, but to restrict players to the use of a single hand while removing bricks. An example of such a game using precisely manufactured polished wooden bricks is sold under the trademark JENGA by the Milton Bradley Company.

A known variant marketed in Canada under the trademark JENGA ULTIMATE utilizes more than one color of rectangular brick, with the different colors randomly distributed throughout the original tower. A die is rolled to determine what color brick must be removed during the next round of play, thereby adding an element of chance to the game's outcome.

Although the described games use bricks having length to width ratio of about 3:1, whereby three bricks may be initially arranged in a compact square layer having three contiguous bricks, similar tower building games are known in which somewhat narrower rectangular blocks are initially spaced apart horizontally. Other known variants use plastic rectangular bricks.

DISCLOSURE OF INVENTION

The present invention improves on the play appeal of the known tower building games by providing additional variants and alternates requiring different levels of manual dexterity and/or different strategies, thereby providing play appeal for different classes of players.

In accordance with an overall aspect of the invention, at least two types of bricks are used to build the tower, with the two types of bricks having different physical characteristics which interact to affect the stability of the tower and/or the ease with which a particular brick can be removed.

In accordance with a first specific aspect of the invention, each layer of the tower is formed from bricks having possibly similar physical properties, but at least two adjacent layers of the tower are formed from different shapes, sizes and/or numbers of bricks.

In accordance with a second specific aspect of the invention, the different physical properties include weight, surface configuration and/or coefficient of friction, thereby rendering it easier or more difficult to remove certain types of bricks having a particular spatial relationship in the tower with respect to other types of bricks.

In accordance with a third specific aspect of the invention, the shapes, sizes and/or other physical characteristics of the various types of bricks affect the ease with which certain bricks may be handled.

In accordance with a fourth specific aspect of the invention, the shapes of the different types of bricks are such that adjacent bricks of a first type in a first layer may be frictionally coupled together by a second type of brick in an adjacent second layer, but none of the bricks in the second layer are coupled together by the bricks in the first layer.

In accordance with a fifth specific aspect of the invention, the sizes or shapes of at least some of the bricks is such that a single layer may have at least three key bricks, the removal of any one of which will result in the collapse of the tower.

As presently contemplated, two or more types of tower building bricks may be packaged as a self-contained tower building game, or a set of non-rectangular bricks may be used to supplement an existing set of conventional rectangular tower-building bricks, thereby providing enhanced play appeal at a minimal expense.

In accordance with another aspect of the invention, the tower of bricks is built on a revolving turntable to enhance each player's access to all sides of the tower and/or to limit the time for each player to make his move, and the turntable is preferably provided with a level to provide a level base for the construction of the tower.

BEST MODE FOR CARRYING OUT THE INVENTION

Figure 1:
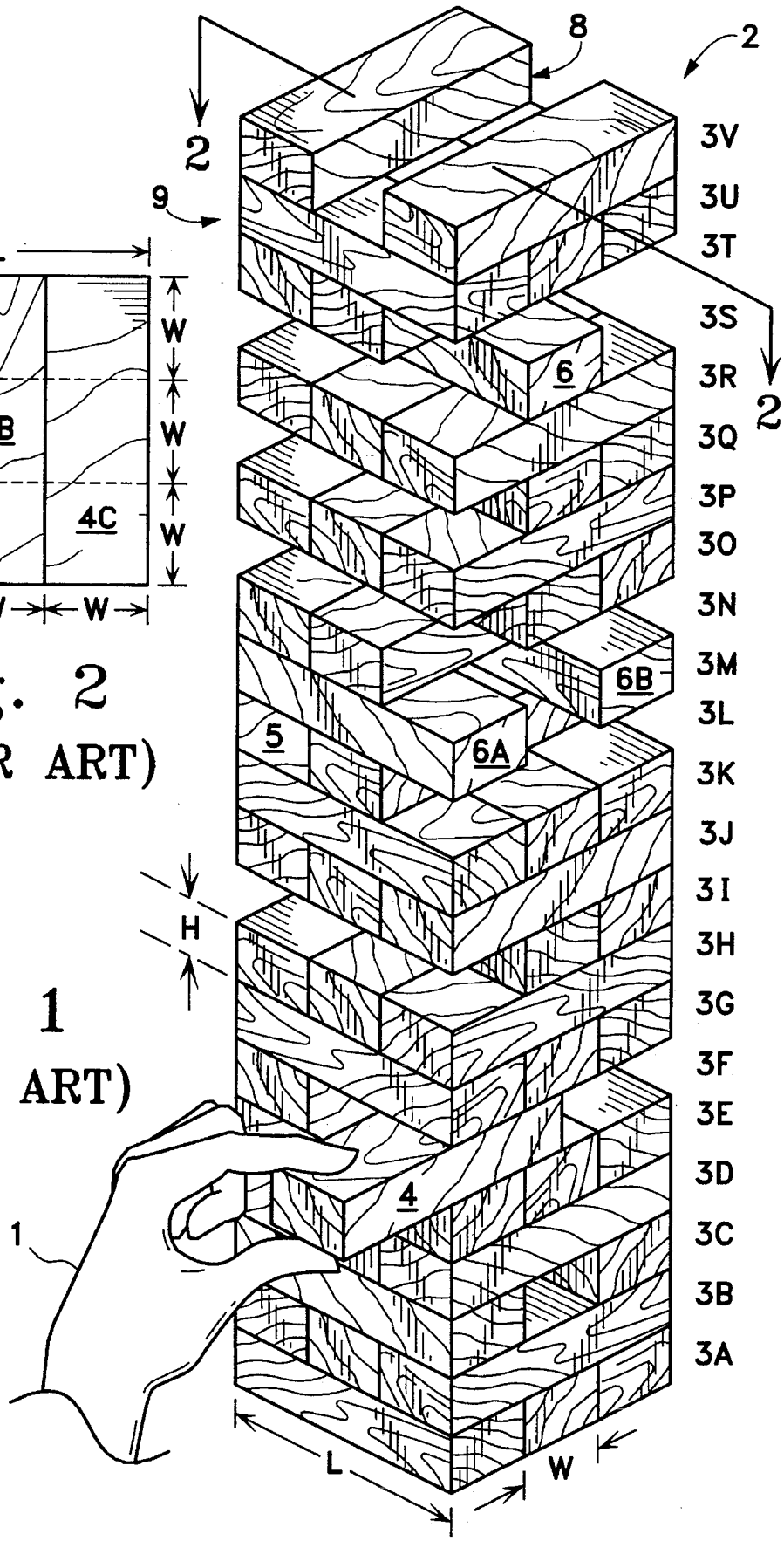
Fig. 1 (PRIOR ART)
FIG. 1 shows a prior art tower building game using a single size and shape of rectangular bricks.

Referring to FIG. 1, which shows a single player 1 playing a conventional tower building game such as the above mentioned JENGA game, it may be seen that prior art tower 2 is formed in conventional fashion from layers 3 of rectangular bricks 4. Each prior art rectangular brick 4 has the same height H, and (as may be better seen in the plan view of FIG. 2) a width W equal to precisely one-third of its length L, whereby three contiguous bricks 4A,4B,4C form a square layer 3 having a vertical dimension of H and a horizontal dimension of L=3W.

Referring again to FIG. 1, a number of rectangular bricks 4 are initially arranged in layers 3A,3B,3C, . . . ,3R to form the tower 2, with the orientation of the rectangular bricks 4 in a first layer 3A being perpendicular to that in an adjacent second layer 3B to provide mechanical interlocking (frictional coupling) between the individual bricks of two crossed layers. During play, the height of the tower is increased by removing bricks from one or more lower layers 3F,3I,3N,3O,3Q to build successive upper layers 3S,3T,3U, 3V. A brick is a key brick if it is directly under the center of gravity of the bricks above it and is (or will be) the only brick in a given layer (eg, single key brick 6), or if it is one of two remaining bricks on either side of the center of gravity of the bricks above it (eg, pair of key bricks 6A,6B). The game ends if the tower 2 becomes unstable and collapses because a key brick 6,6A,6B has been removed, or if the tower 2 collapses during the attempted removal of any brick 4. Since there may be slight variations in the thickness H and surface characteristics of the individual bricks 4, and since the tower 2 may not be exactly vertical, the weight of the upper layers 3G,3H,31, . . . ,3M may not be evenly distributed on all bricks 4 of a given layer 3. Accordingly, it is possible to permit the players 1 to test for loose bricks 5 (which can be readily removed) or key bricks 6 (which can not be removed) before deciding which brick to remove. An example of such a game using precisely manufactured polished wooden bricks is the above mentioned JENGA game.

Figure 3:
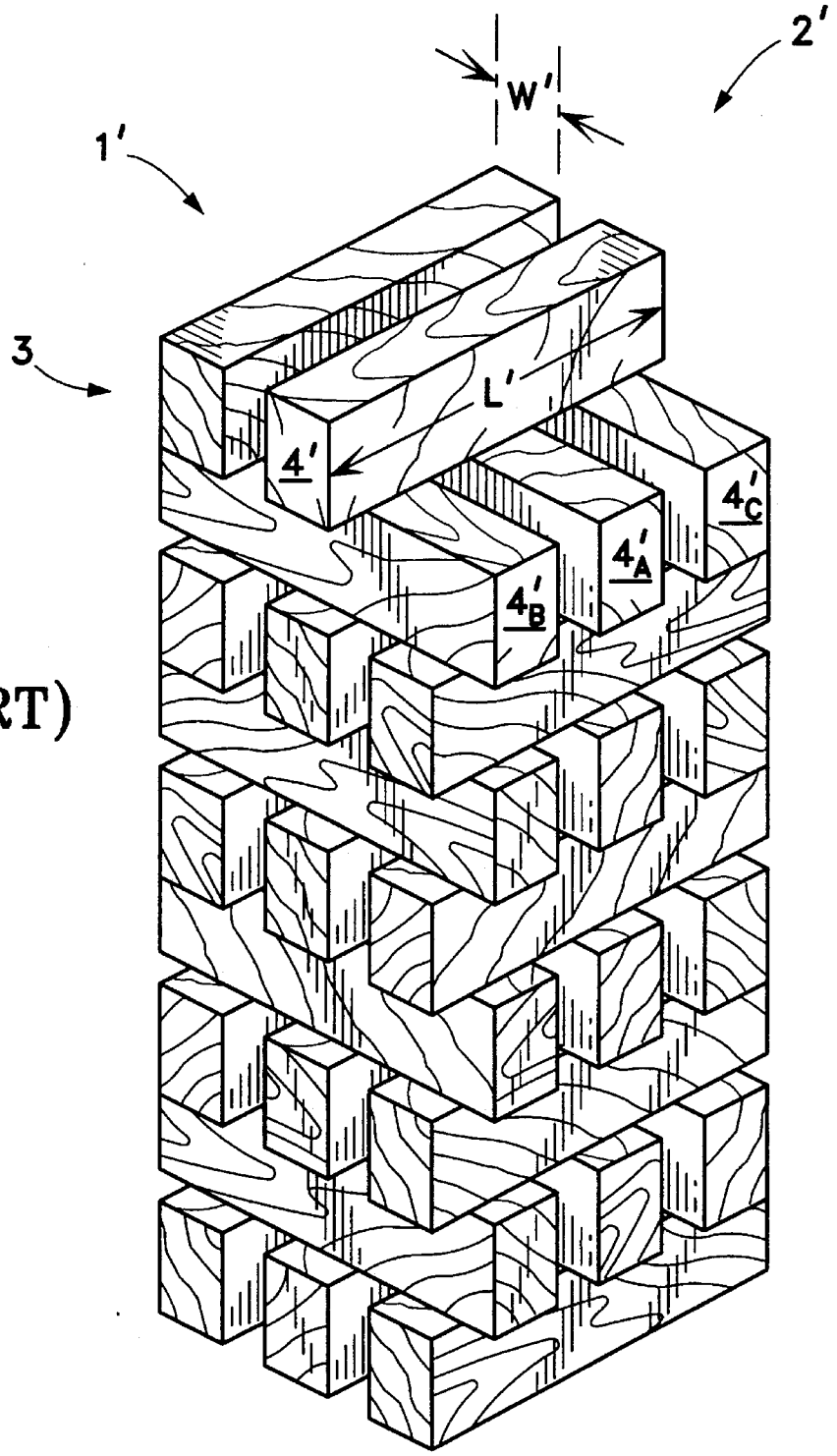
Fig. 3 (PRIOR ART)
FIG. 3 shows a variant of the tower of FIG. 1 wherein a space is provided between the adjacent bricks.

FIG. 3 shows a known variant using modified rectangular bricks 4' having a width W' significantly less than ⅓ of their length L' to thereby provide a space between adjacent bricks 4' of the same layer 3. Such a horizontal spacing facilitates the removal of central brick 4'A by eliminating any possibility of contact with the two outer bricks 4'B,4'C during the removal process. It should thus be apparent that a second (unillustrated) variant is possible incorporating the wider bricks of FIG. 1 with the spaced apart arrangement of FIG. 4, by placing each brick on its shorter edge. Since stability is generally enhanced with a relatively low center of gravity centered above a relatively wide base, stacking each brick on its shorter edge will result in a taller but less stable tower for a given number of bricks.

Figure 2:
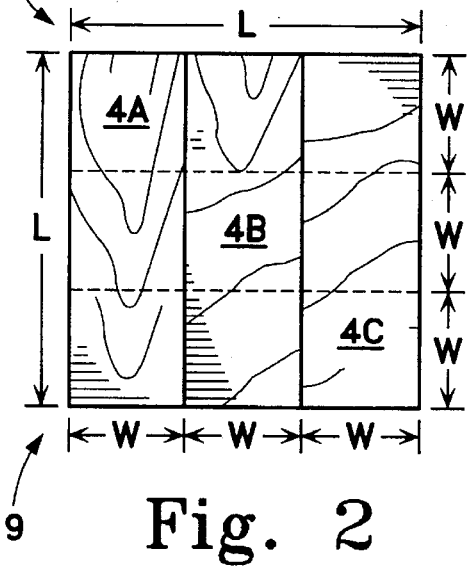
Fig. 2 (PRIOR ART)
FIG. 2 is a plan view of the tower of FIG. 1 showing how a single layer comprises a side-by-side arrangement of three adjacent rectangular bricks.
Figure 5:
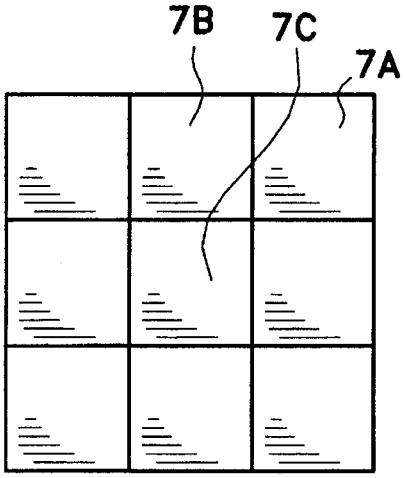
FIG. 5 is a plan view showing how a single layer of the composite tower of FIG. 4 may contain only square bricks.
Figure 6:
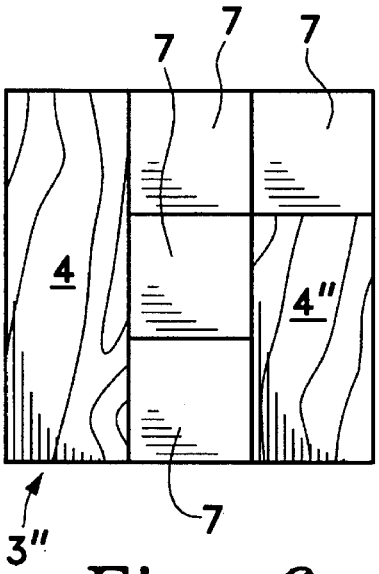
FIG. 6 is a plan view of a single layer of a variant of the composite tower of FIG. 4, showing how a single layer may contain two or more shapes of bricks.
Figure 4:
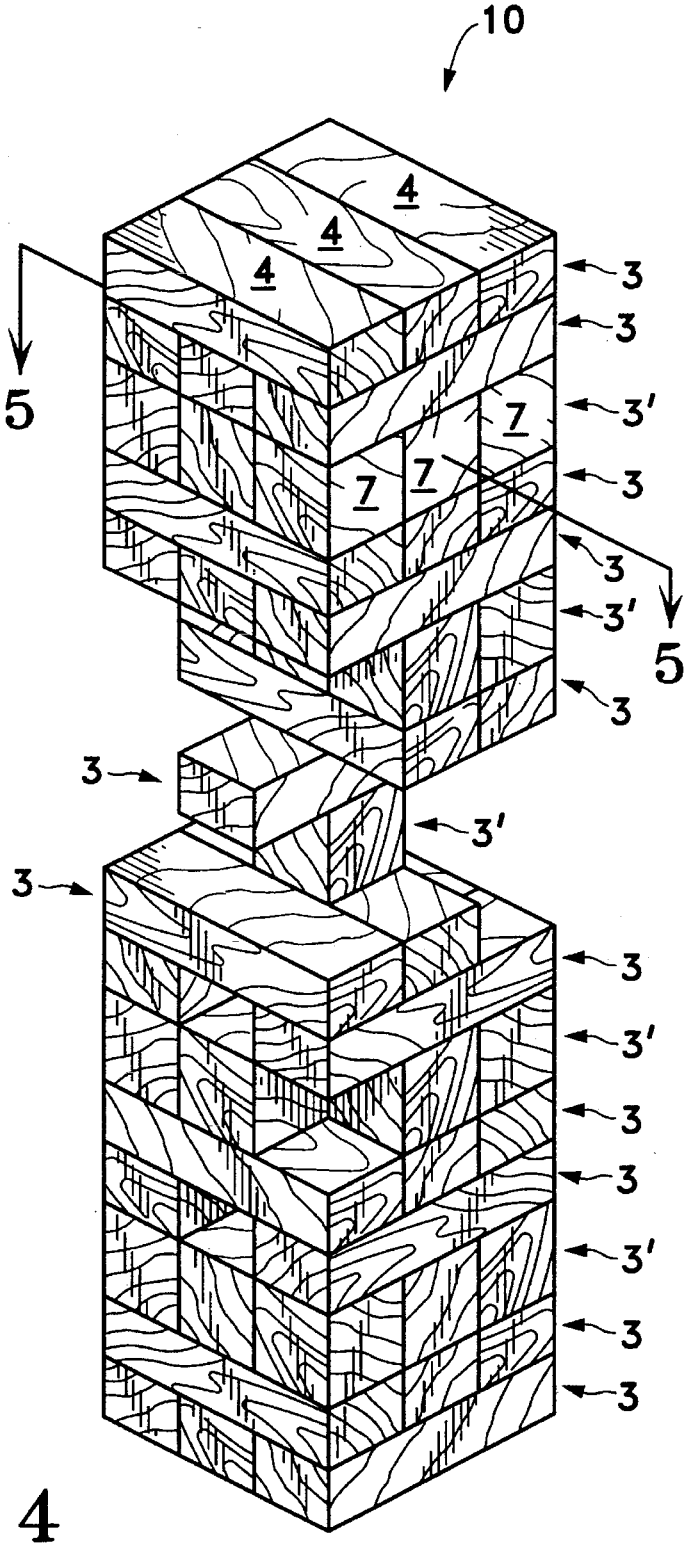
FIG. 4 shows a first embodiment of the present invention, in which a composite tower incorporates a layer of square bricks surrounded from above and below by respective crossed layers of rectangular bricks, wherein all bricks have the same width.

As previously mentioned, the JENGA ULTIMATE variant of the above described JENGA game uses bricks of several different colors, while other tower building games differ from the original JENGA game in that they use rectangular bricks of different dimensions and/or made of different materials. However, in accordance with one aspect of the present invention and as illustrated in FIG. 4, any of the known tower building games can be made more interesting and more challenging by using two or more shapes and/or sizes of bricks including for example not only rectangular bricks 4 but also square bricks 7 to construct a composite tower 10, preferably with each layer 3,3' being constructed from only one shape of brick 4,7 as shown in FIG. 4 and FIG. 5, but with different shapes of bricks being used to construct different layers. Alternatively, as shown in FIG. 6, square 7 and rectangular 4,4' bricks can be combined in a single layer 3. Those skilled in the art will realize that maximum mechanical interlocking between crossed layers will result if the tower 2 is built only of rectangular bricks as shown in FIG. 2, with each rectangular brick 4 being sufficiently long that it extends from one side 8 to the other side other side 9 of the tower 2. Replacing one of the rectangular bricks 4 with two or more square bricks 7 reduces but does not completely eliminate the frictional cross-coupling between the crossed layers, thereby resulting in a somewhat less stable tower that is more sensitive to out-of-level conditions and requires more dexterity to construct. Accordingly, the embodiment of FIG. 4 represents a marked improvement in the play value over the known games illustrated in FIG. 1 and FIG. 3.

Assuming that the rules of the game allow the use of only one hand, and do not permit the simultaneous removal of more than one brick or the sliding of one brick into a position previously occupied by a second brick, it will be apparent that if a single layer contains nine square bricks 7 closely packed into a 3×3 square, as illustrated in FIG. 5, then at least one corner brick 7A must be removed before the player can get a grip on a middle brick 7B and at least two middle bricks 7B must be removed before the player can get a grip on the center brick 7C.

Figure 7:
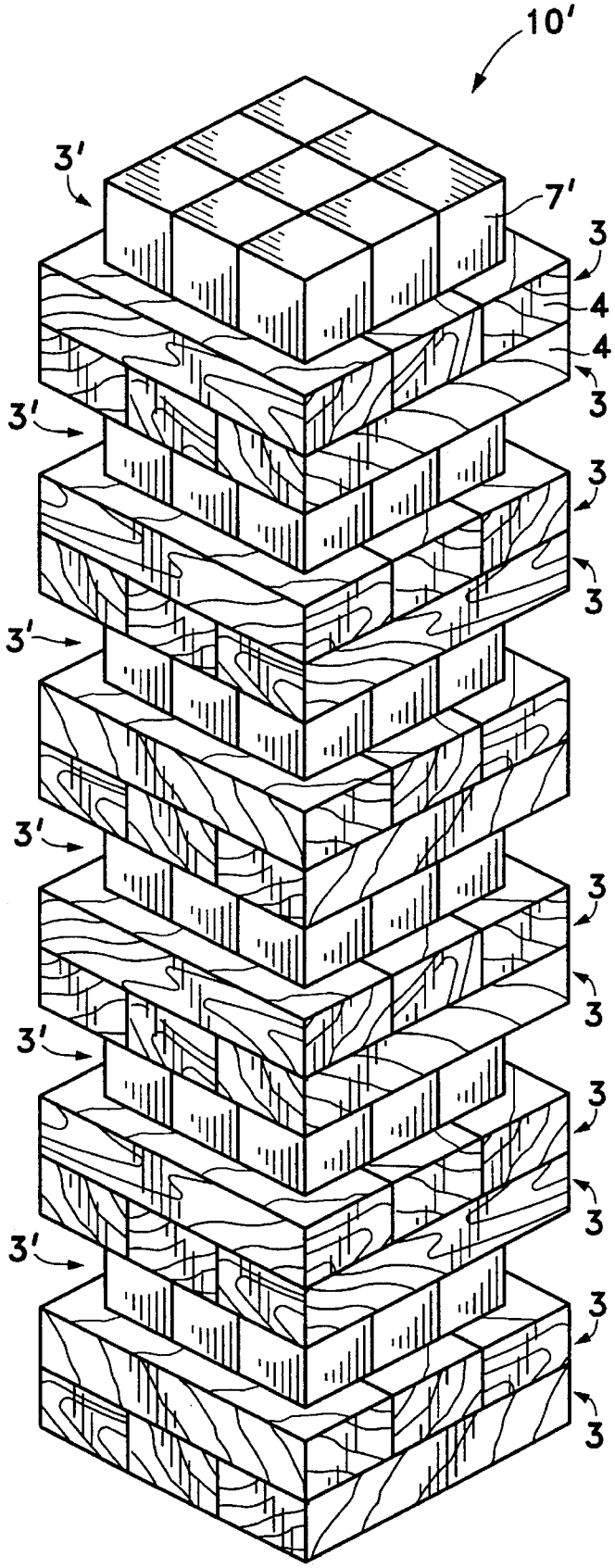
FIG. 7 shows a first variation of the composite tower of FIG. 4, wherein the widths of the two types of bricks is not the same and all the bricks are packed tightly together.

Combining different shapes of bricks 4,7 also adds to the strategic aspects of the game, because the stability of the composite tower 10 constructed from two or more types of brick 4,7 is affected not only by the levels A,3B, . . . ,3M in which the two types of bricks are placed, but also by how the rectangular bricks 4 above and below the square bricks 7 are oriented with respect to one another. For example, a somewhat more stable structure will result if, as shown in FIG. 4 and FIG. 7, the layer of rectangular bricks above the layer with the square bricks is oriented with its main axis perpendicular to that of the layer of rectangular bricks below the layer of the square bricks, with the square bricks serving to couple the interlocking forces between the two spaced apart, perpendicularly oriented layers of rectangular bricks. Further, as is clear from an inspection of FIG. 5, combinations not only of one brick (eg center brick 7C) or two bricks (eg, two middle bricks 7B in a middle row or column arranged to support a single key rectangular brick above that middle row or column, but also of four corner bricks 7A or two middle bricks 7B arranged above two key rectangular bricks above two outer rows or columns, may function as key bricks in a given layer of nine square bricks. Moreover, it is not essential (unless the rules so provide) that all nine square bricks must be initially placed in layer of square bricks before any rectangular bricks may be placed in the next layer, but only that it include one or more key bricks arranged to support the key bricks in the next layer.

FIG. 6 is a plan view of yet another variant of the composite tower embodiment of FIG. 4 in which a single layer may contain two or more shapes of bricks 4,7,4', thereby adding further to the strategy and skill required to play the game. Moreover, even two bricks of the same size and shape may have different weights, in which case the removal of a heavy outside brick will be more likely to cause an imbalance torque and possible toppling of the tower than the removal of a lighter brick at the same location.

FIG. 7 shows another embodiment of the present invention in which the different bricks 4,7' vary in both size (width) and shape (square vs rectangle), but with each layer consisting of only one type of brick in a tightly packed configuration, thereby resulting in an overlapping orientation between the bricks of adjacent layers.

Figure 8:
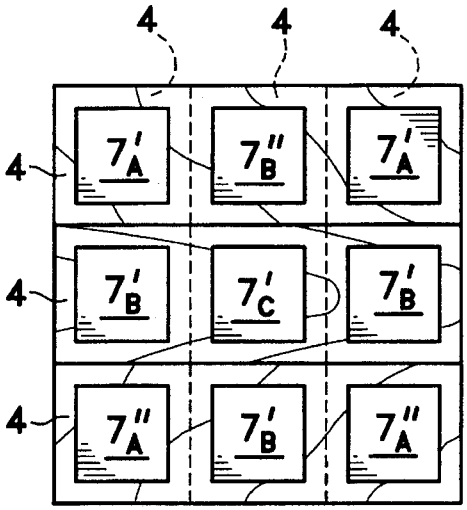
FIG. 8 is a plan view of a second variation of the composite tower of FIG. 4, wherein the widths of the two types of bricks is not the same and at least the narrower bricks are packed loosely.

As shown in FIG. 8, some or all of the narrow square bricks 7' of FIG. 7 can be separated horizontally from each other similar to the spaced construction shown in FIG. 3. By combining loosely packed layers of narrower square bricks 7' with tightly packed layers of wider rectangular bricks 4, each square brick 7' will be in full contact with only one rectangular brick 4 above and only one rectangular brick below it. In such a configuration, a rectangular brick 4 can be removed only if it is not the lower support of a square brick; however, a single square brick 7' can support a rectangular brick, which may in turn be cantilevered by the weight of additional upper layers. Moreover, because of the loose spacing between the square bricks 7', in contrast to the closely packed configurations of FIG. 5 and FIG. 7, it is possible to pull out a middle brick 7B without first removing any of the four corner bricks 7A. Thus it will be appreciated that not only the appearance but also the play appeal of the FIG. 8 embodiment is further enhanced by making the two types of bricks of different widths. FIG. 8 also illustrates that two corner bricks 7"A and one middle brick 7"B may be key bricks. To further facilitate the removal of a middle brick 7"B, at least some of the square bricks 7' can be made of a ferrous material or provided with keyholes or other means for engaging a magnetized or appropriately configured removal tool.

Figure 9:
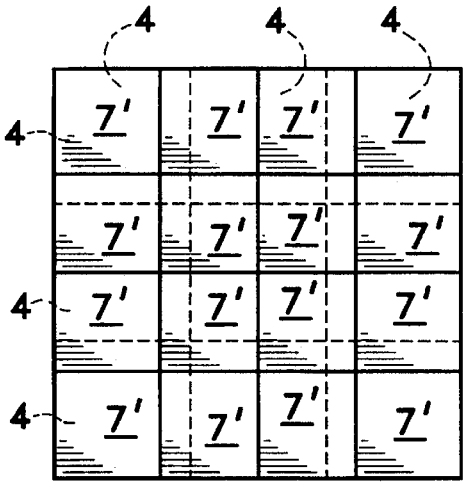
FIG. 9 is a plan view of two adjacent layers in a third variation of the game of FIG. 4, wherein the widths of the two types of bricks is not the same, but the number of narrower bricks is increased so that the narrower bricks occupy in the aggregate approximately the same area as the wider bricks.

FIG. 9 shows another variant of the embodiments of FIGS. 7 & 8 in which the number of smaller square bricks 7' is increased to sixteen so that the smaller bricks occupy in the aggregate approximately the same area as the nine square bricks 7 of the FIG. 8 embodiment. In that case there will be an overlapping arrangement between the two widths of bricks 4,7' which provides frictional coupling even between the square bricks 7', thereby providing additional stability, which in turn further complicates the strategy of determining which bricks 4,7' can be safely removed.

Figure 10:
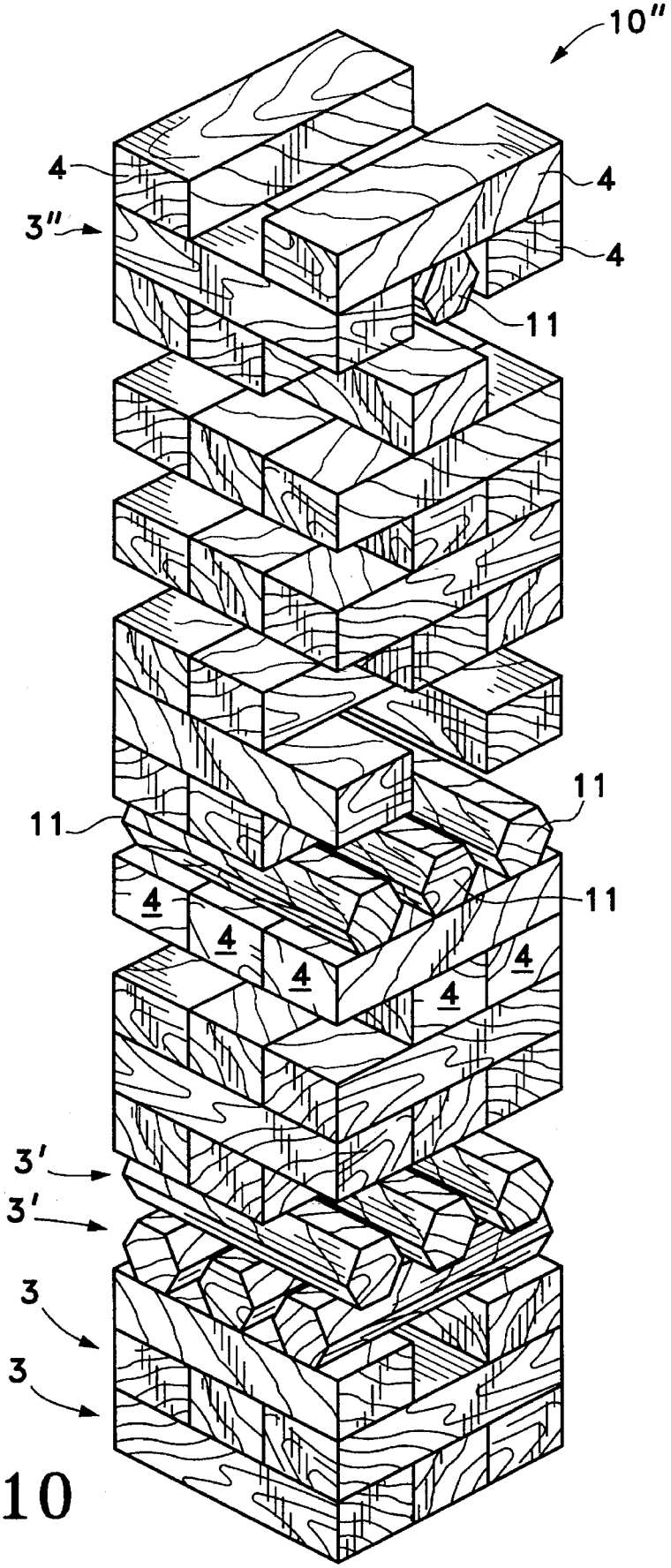
FIG. 10 shows a another embodiment in which at least some of the rectangular bricks are supported on a relatively small horizontal surface of bricks having a non-rectangular cross section in a vertical plane, with the two shapes of bricks having different physical properties.

Reference should now be made to FIG. 10, which shows a third embodiment of the present invention in which at least some of the bricks 11 have a hexagonal or other non-rectangular cross section in a vertical plane transverse to the brick's longitudinal axis, with the hexagonal bricks 11 being used to replace some or all of the layers of rectangular bricks 4 in the prior art towers 2,2' of the FIG. 1 and FIG. 3 embodiments. Note that in the illustrated embodiment, some layers 3" contain both types of bricks 4, 11, while other layers 3,3' each contain only one type of brick. As will become clear from the description of the various variant towers shown in FIGS. 10, 11 & 12, the hexagonal bricks 11 provide only a line contact between adjacent bricks of the same layer thereby combining the advantages of the closely packed arrangement of FIG. 1 (accurate alignment of the individual bricks) and the spaced apart arrangement of FIG. 3 (ease of removal). Those skilled in the art will realize that a reduced contact area between adjacent bricks in the same level may also be achieved with other non-rectangular vertical profiles, or a combination of rectangular and non-rectangular profiles. The two types of bricks 11,4 may be formed of different materials having different coefficients of friction, which will further emphasize the variations in tactile feel resulting from the different sizes of the contact area between the different sizes and shapes of bricks.

Figure 11:
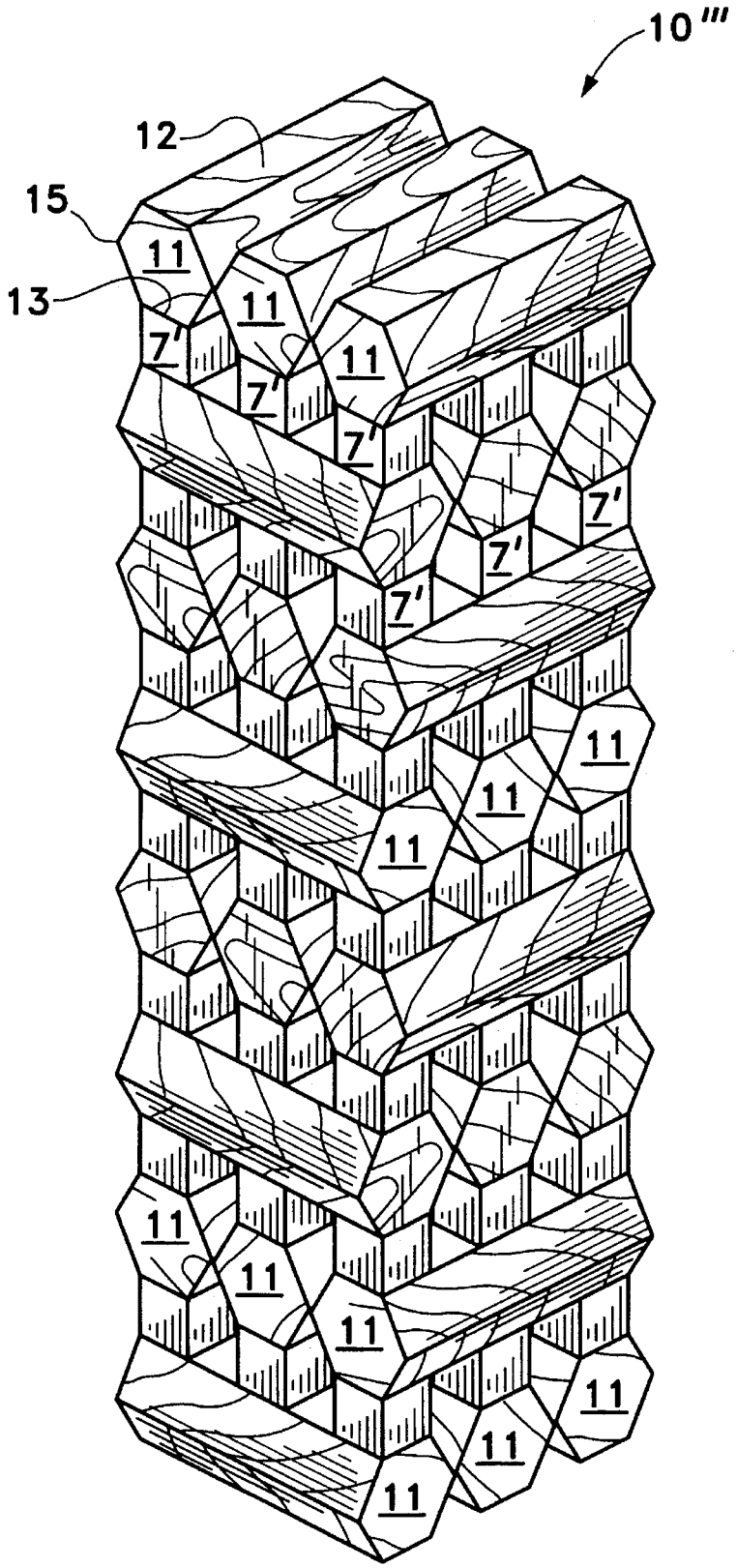
FIG. 11 shows a variant of the embodiment of FIG. 10 in which square bricks are supported on the relatively small horizontal surface of the bricks having a non-rectangular cross section in a vertical plane.

In FIG. 11, at least some of the elongated bricks 11 have a relatively small horizontal surface which supports the square bricks 7'. By orienting the hexagon with two parallel flat surfaces 12, 13 on top and on bottom, each side 14 will not be vertical, but will have a protruding center 15 which maintains the top and bottom surfaces 12, 13 in a spaced apart relationship, even if two adjacent bricks 11 touch each other at their center 15, thereby combining the less stable (and therefore more challenging) aspects of the spaced apart configuration of FIG. 7 with the self-aligning aspects of the closely spaced configuration of FIG. 1. Such a form of construction combines the advantages of the narrow, spaced apart square bricks of the FIG. 8 embodiment (eg, greater accessibility of the middle bricks) with the advantages of maintaining at least a small area of contact between adjacent blocks in the same layer (self-spacing), to provide an especially challenging and aesthetically pleasing game.

Figure 12:
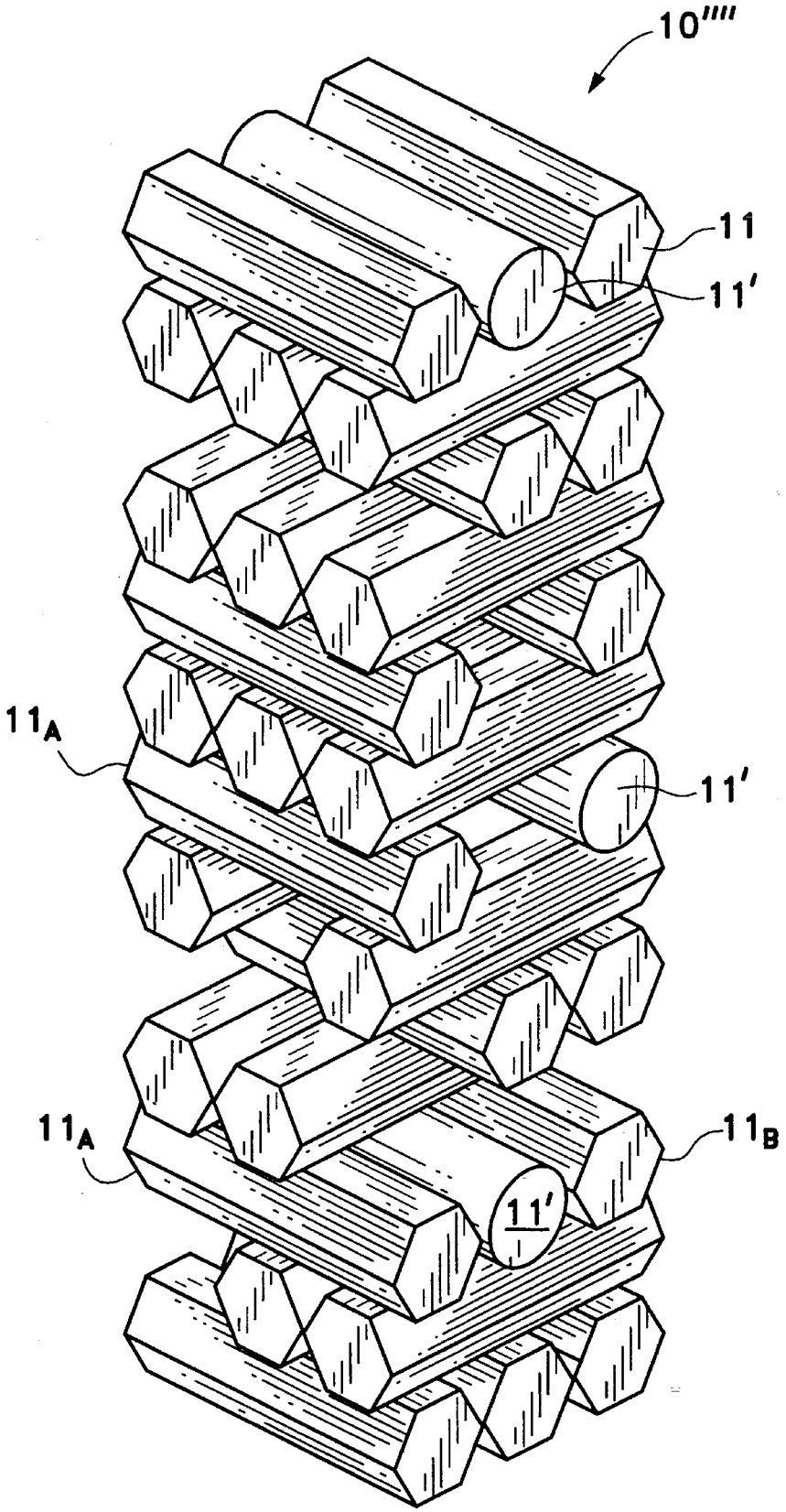
FIG. 12 shows a second variant of the embodiment of FIG. 10 utilizing two types of bricks each having a different non-rectangular cross section.

FIG. 12 shows a variant tower constructed only of elongated bricks 11,11' having a non-rectangular vertical cross section in the plane transverse to the brick's longitudinal axis, including one or more bricks 11' having a circular cross section, Such circular bricks may even function as one of two key bricks 11A,11B'; however it will be appreciated that if a given layer contains only circular bricks with parallel axes, the tower will be unstable. It will be appreciated that other combinations of vertical cross section are possible, for example square and triangular, provided all the bricks in the same layer have the same height.

Figure 13:
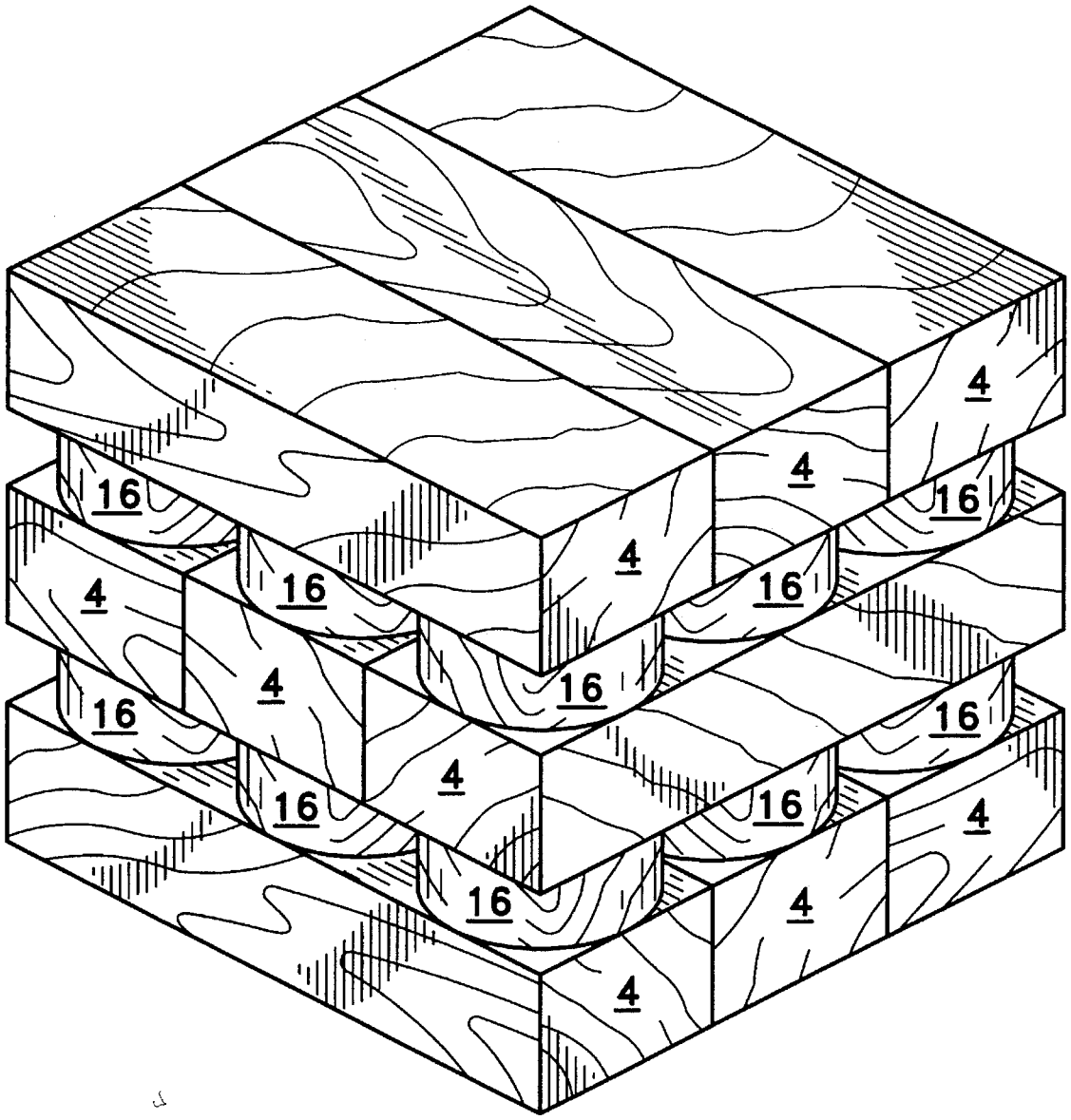
FIG. 13 shows a third embodiment of the present invention wherein at least some of the bricks have a non-rectangular cross section in a horizontal plane.
Figure 14:
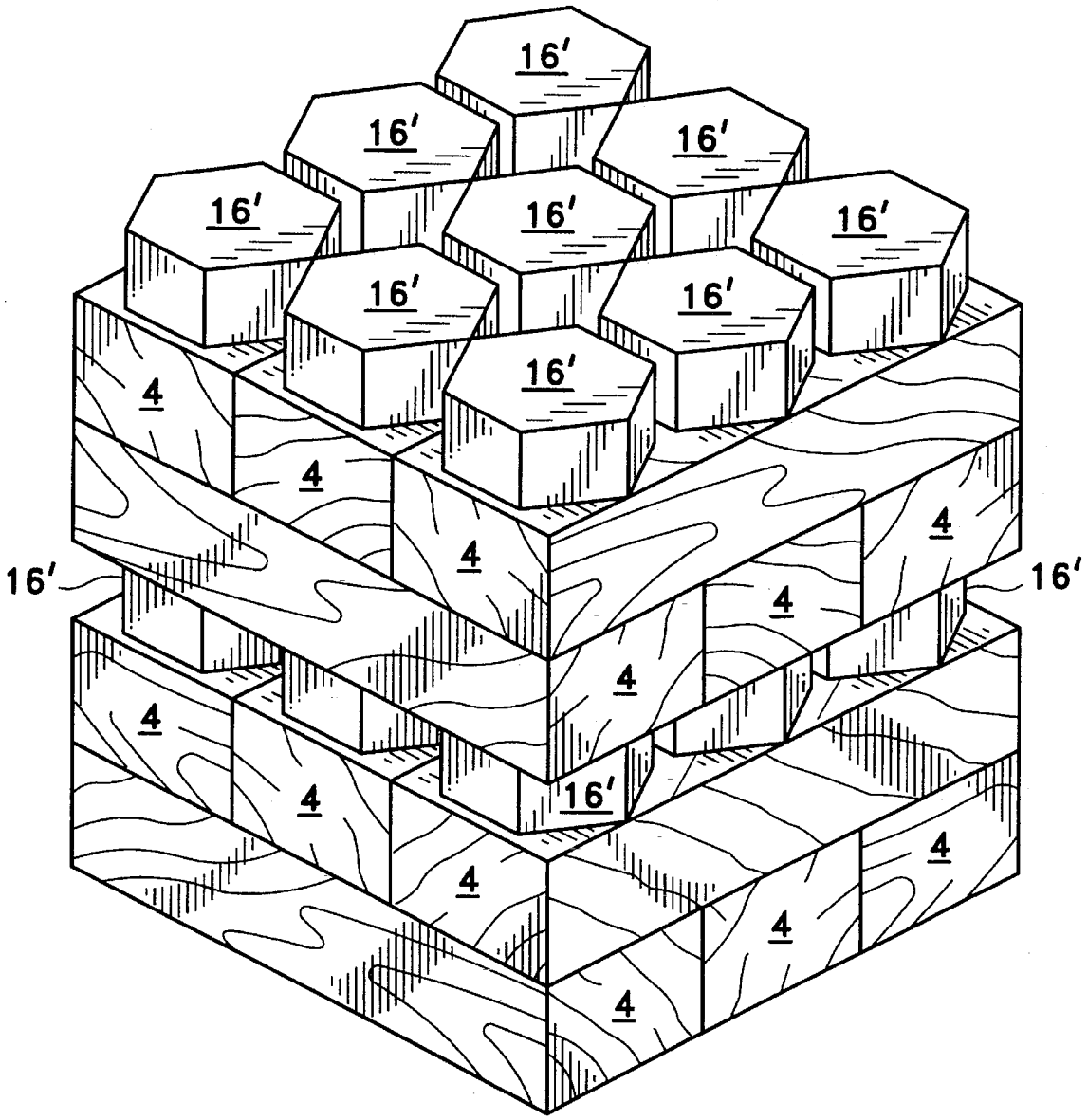
FIG. 14 shows a variant of the embodiment of FIG. 13 wherein the bricks having the non-rectangular cross section are packed closely together in an interlocking arrangement in which the bricks of adjacent layers are oriented in different directions.

FIGS. 13 & 14 shows embodiments in which at least some of the bricks have a non-rectangular cross-section in the horizontal plane. In the embodiment of FIG. 13, the non-rectangular cross-section is circular and the brick 16 is a vertical cylinder; in the embodiment of FIG. 14, it is a brick 16' whose horizontal cross section is hexagonal. It should be apparent that other horizontal cross sections are also possible, including other shapes such as ovals, irregular polygons, and other regular polygons. Since as mentioned previously, stability is to a large measure a function of the ratio of height to width, it is also possible to change the difficulty of play, and/or to discourage or facilitate building towers of a predetermined height and/or having a predetermined number of levels, by adjusting the height of the non-rectangular bricks 16, 16'.

Although such non-rectangular horizontal cross-sections are in some respects similar to the square bricks in FIG. 4 and FIG. 7, they in general have the advantage that although adjacent bricks may be in contact with one another (thereby permitting the spacing between the bricks to be maintained to a value corresponding to the fixed spacing of the rectangular bricks in the other layers), there is nevertheless a protruding surface which may be readily gripped by the player without disturbing the other bricks. Another advantage of a brick having a non-rectangular cross section is the fact that it does not have a constant width and therefore, as such a brick is being removed, the change in its contact area with adjacent bricks is not a linear function of its displacement, resulting in a non-linear tactile feed-back that is different from that associated with a linear change in contact area produced by a rectangular brick being displaced in the direction of its longitudinal axis.

Figure 15:
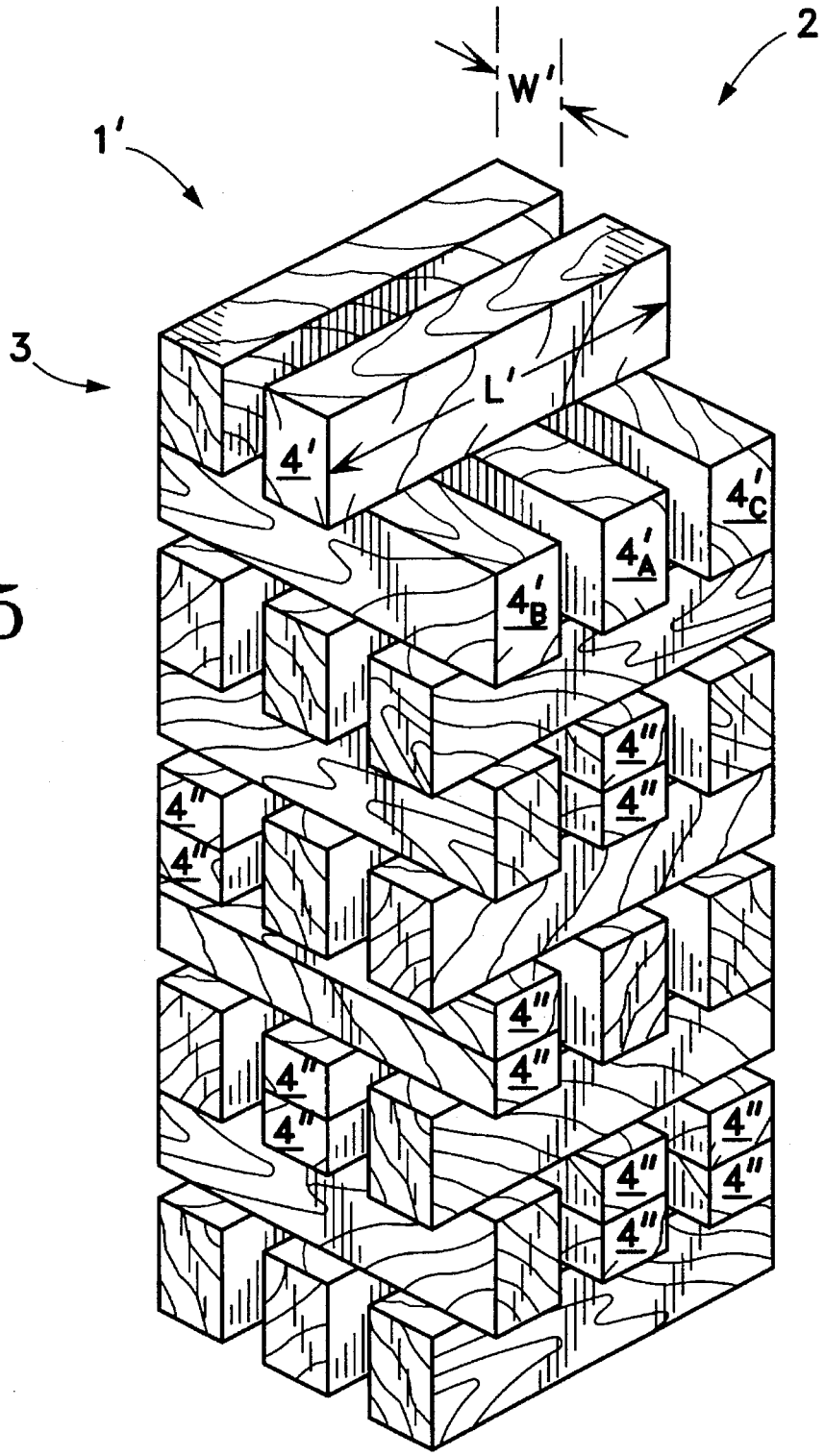
FIG. 15 shows yet another variant having two types of rectangular bricks, with the height of the first type of brick being an integral multiple of the height of the second type of brick.

As shown in FIG. 15, some of the rectangular bricks 4" may be short bricks that have a height H" that is an integral fraction (for example one half) the height H' of a tall prior art brick 4', whereby a stacked combination of first and second short bricks 4" may provide the same support as a single tall brick 4', but upon removal of the first such short brick by a first player, the removal of the second short brick is trivial, thereby in effect providing a free move to the second player. Combinations of full and half (or other integral fractions such as one third) height bricks are also possible with bricks having a non-rectangular cross section, for example the hexagonal bricks 11 of FIG. 10.

In addition to shape and size, other physical aspects of some, but not necessarily all, of the bricks may be manipulated to further enhance the play appeal, without departing from the spirit of the present invention. For example, as indicated by the different surface shadings in FIGS. 6, 7, 8, 9, 11 & 14, some bricks may have a different surface texture or configuration (eg, coefficient of friction) than other bricks (or perhaps a non-linear coefficient of friction that is dependent on load per unit area) resulting in a higher likelihood that removal of a non-key brick will cause an unpredictable movement in the bricks in other layers. As another example, some of the bricks could contain hidden magnets and/or be made of magnetic material, thereby resulting in unpredictable non-gravitational forces between certain bricks (but not other bricks) which would be apparent only when an apparently loose brick is removed. As a third example, some of the bricks could be solid while others could of a second type with a weighted or a hollowed out center (preferably not visible upon visual inspection), thus resulting in a greater shift in the center of gravity when the heavier type of brick is removed.

Figure 16:
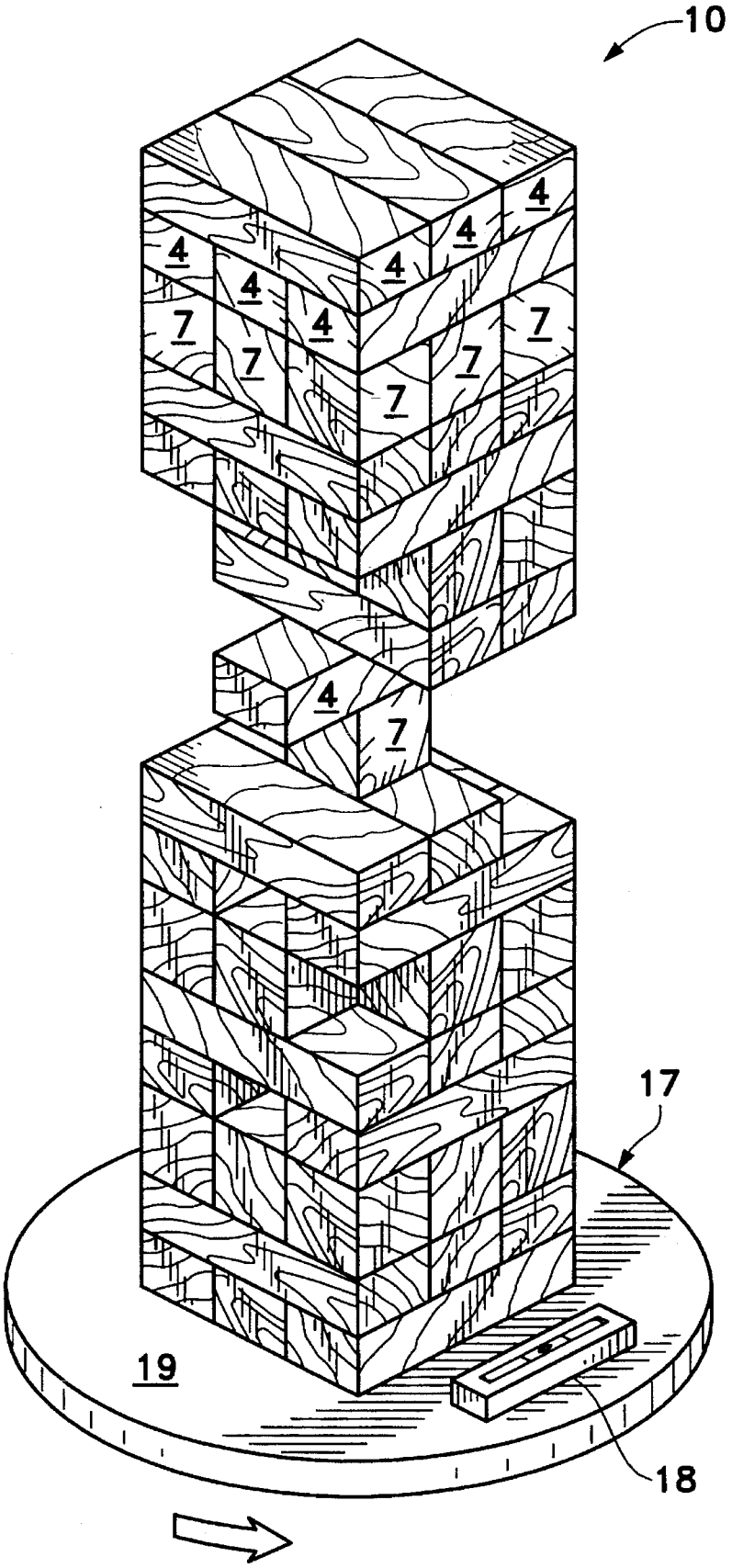
FIG. 16 shows a tower building game wherein the tower is built on a revolving turntable having a built-in level.

FIG. 16 shows how the play appeal of the tower building game may be further improved by means of suitable accessories. In FIG. 16, the composite tower 10 is constructed on a rotating turntable 17, which may be rotated at a constant angular velocity by means of a clockwork or electric motor (not shown) similar to that found in a microwave oven. This not only permits the players to see the entire composite tower 10 from all angles, but also establishes a preset time period (for example, one and one half revolutions) during which each player must make his move. Preferably a level 18 may be incorporated into the rotating turntable 17, thereby ensuring that the upper surface 19 of the turntable 17 is always horizontal and thus that towers 2,2', 10 may always be maintained in a stable vertical position as they are rotated on the turntable 17. If the game is to be played outdoors on sand or grass, stability may be enhanced by employing a platform with legs, preferably provided with a turntable similar to turntable 17 and a measuring stick of tape to monitor the height of the tower just before it collapses. Similarly, if the game is to be played indoors, a mat of felt or woven cloth may be employed to catch the falling bricks and to protect adjacent polished wood surfaces from being scratched or dented. If the mat is to be used on an uneven surface such as tiles or carpet, it may be provided with a cardboard or wooden insert to provide a flat and level surface on which to build the tower.

We claim:

1. A stacking brick tower game, comprising:

a primary horizontal layer of exactly n primary bricks;

a secondary horizontal layer of greater than n bricks on top of said primary layer; and a plurality of additional horizontal layers, wherein:

n is at least 3;

the aggregate surface area of the top surfaces of all the primary bricks in said primary horizontal layer is at least as great as the aggregate surface area of the top surfaces of all the secondary bricks in said secondary horizontal layer;

each of the primary bricks has a rectangular horizontal cross section defined by a predetermined length and a predetermined first width equal to or less than said predetermined length divided by n; and at least one of the bricks in the secondary layer is a square brick having a square horizontal cross section defined by a predetermined second width equal to or less than said predetermined first width and having a fixed relationship to said predetermined first width.

2. The invention of claim 1, wherein each of the primary bricks has a respective height less than said predetermined first width.

3. The invention of claim 1 wherein n equals 3.

4. The invention of claim 1 wherein the aggregate surface area of the top surfaces of all the primary bricks in the primary layer substantially equals the aggregate surface area of the top surfaces of all the secondary bricks in the secondary layer.

5. The invention of claim 1 wherein the sum of the surface areas of the top surfaces of each of the primary bricks in the primary layer exceeds the sum of the surface areas of the top surfaces of the secondary bricks in the secondary layer.

6. The invention of claim 1 wherein the edges of the top surface of each of the secondary bricks are formed of straight lines.

7. The invention of claim 6, wherein all of the bricks in the secondary layer are said square bricks.

8. The invention of claim 6, wherein the width of a brick in the primary layer is substantially equal to the width of a brick in the secondary layer.

9. Game apparatus of claim 1, wherein at least some of said bricks have a non-rectangular vertical cross section.

10. The invention of claim 1, wherein the secondary layer includes at least n×n of said square bricks.

11. A method for playing a stacking brick tower game with a plurality of rectangular bricks all having a same first width and a same first length at least equal to three times said same first width and a plurality of short bricks all having a same second width and a same second length, said second length being substantially equal to said second width and less than said first length, comprising the steps:

building a first primary layer of exactly n rectangular bricks oriented in a first direction;

building a secondary layer of greater than n bricks on top of said first primary layer, said secondary layer including at least two short bricks;

building a second primary layer of exactly n rectangular bricks oriented in a second direction perpendicular to the first direction on top of said first secondary layer;

removing a rectangular brick from said layers;

placing the removed rectangular brick on top of said second primary layer to begin a third primary layer above said second primary layer with the removed rectangular brick oriented in said first direction, removing one of the short bricks from the secondary layer, and placing the removed short brick on top of said third primary layer to thereby begin a second secondary layer.

12. The method of claim 11, wherein prior to the building of the third primary layer and the second secondary layer, each of the rectangular bricks in the first primary layer supports exactly n secondary bricks in the first secondary layer, and each of the primary bricks in the second primary layer is supported by only n secondary bricks in the first secondary layer.

13. The method of claim 11, wherein prior to the building of the third primary layer and the second secondary layer, each of the n rectangular bricks in the first primary layer supports more than n short bricks in the first secondary layer, and each of the n rectangular bricks in the second primary layer is supported by more than n short bricks in the first secondary layer.

14. The method of claim 11, wherein the secondary bricks are tightly packed together.

15. The method of claim 11, wherein the secondary bricks are loosely packed together.

16. The method of claim 11, wherein the first secondary layer comprises four corner bricks, at least four middle bricks, and at least one central brick, and each central brick is surrounded by four middle bricks.

17. The method of claim 11, wherein the short bricks have a non-rectangular horizontal cross section.

18. The method of claim 11, wherein the short bricks have a square horizontal cross section.

19. The method of claim 11, wherein said first width is equal to said second width.

* * * * *